US009045206B2

(12) United States Patent
Flythe, Jr. et al.

(10) Patent No.: US 9,045,206 B2
(45) Date of Patent: Jun. 2, 2015

(54) SURVIVAL EQUIPMENT VEST INCORPORATING FLOTATION BLADDER

(71) Applicant: Aerial Machine & Tool Corp., Meadows of Dan, VA (US)

(72) Inventors: Joseph J. Flythe, Jr., Camden, NC (US); John D. Marcaccio, Mt. Airy, NC (US); Timothy Perkins, Virginia Beach, VA (US); Regina F. Scott, Bassett, VA (US)

(73) Assignee: Aerial Machine & Tool Corp., Meadows of Dan, VA (US)

( * ) Notice: Subject to any disclaimer, the term of this patent is extended or adjusted under 35 U.S.C. 154(b) by 103 days.

(21) Appl. No.: 13/963,231

(22) Filed: Aug. 9, 2013

(65) Prior Publication Data

US 2015/0044922 A1 Feb. 12, 2015

(51) Int. Cl.
*B63C 9/125* (2006.01)
*A41D 13/00* (2006.01)

(52) U.S. Cl.
CPC ..... *B63C 9/1255* (2013.01); *A41D 13/0012* (2013.01)

(58) Field of Classification Search
CPC ..... B63C 9/00; B63C 9/08; B63C 9/093; B63C 9/11; B63C 9/1255; A41D 13/0012
USPC ..... 441/90, 92, 94, 106, 112, 114, 116; 2/102
See application file for complete search history.

(56) References Cited

U.S. PATENT DOCUMENTS

| | | | | |
|---|---|---|---|---|
| 3,266,070 | A | 8/1966 | O'Link | |
| 3,681,801 | A * | 8/1972 | Bel | 441/118 |
| 4,097,947 | A | 7/1978 | Kiefer | |
| 5,692,933 | A | 12/1997 | Bradley et al. | |
| 5,759,076 | A | 6/1998 | Bateman et al. | |
| 6,108,816 | A | 8/2000 | Bradley | |
| 6,233,740 | B1 | 5/2001 | Meyers et al. | |
| 6,589,088 | B1 | 7/2003 | Maness | |
| 6,766,535 | B2 | 7/2004 | Duhamell et al. | |
| 6,837,764 | B2 | 1/2005 | Bradley | |
| 6,857,136 | B1 | 2/2005 | Bradley et al. | |
| 7,182,662 | B2 | 2/2007 | O'Meara et al. | |
| 7,824,239 | B2 | 11/2010 | Weinel et al. | |
| 2008/0311808 | A1 | 12/2008 | ONeill et al. | |

FOREIGN PATENT DOCUMENTS

GB 2407067 4/2005

OTHER PUBLICATIONS

Picture of AIRSAVE CMU-33 aircrew survival vest (prior to Aug. 9, 2013).

* cited by examiner

*Primary Examiner* — Lars A Olson
(74) *Attorney, Agent, or Firm* — Banner & Witcoff, Ltd.

(57) ABSTRACT

A survival vest may include a vest body. The vest body may include a bladder containing pouch extending through left front, left shoulder, scapular, right shoulder and right front sections. That pouch may include a bladder release gap. A plurality of equipment attachment loops may be located on exterior faces of the vest. An inflatable bladder may be contained within the bladder containing pouch and may be configured to expand outside the bladder containing pouch through a bladder release gap upon inflation so as to push a left abdominal section of the vest body to the left and push a right abdominal section of the vest body to the right.

20 Claims, 13 Drawing Sheets

SURVIVAL EQUIPMENT VEST INCORPORATING FLOTATION BLADDER

BACKGROUND

Aircraft crew members often wear flight gear that includes various types of survival equipment. For many missions, such survival equipment may include some type of inflatable flotation device for use if a crew member must enter the water. However, numerous other types of survival equipment may be attached to flight gear worn by a crew member. Examples of such equipment can include a radio, a first aid kit, a knife, a flashlight, survival rations, water, dye markers, flares, and/or a pistol.

One known type of flight gear for holding survival equipment is the "Airsave" CMU-33 aircrew survival vest. As the name implies, the CMU-33 includes a vest that can be worn by a crew member. The front and sides of the vest include numerous MOLLE (MOdular Lightweight Load-carrying Equipment) system attachment locations formed from rows of PALS (Pouch Attachment Ladder System) webbing. A flotation collar containing an inflatable bladder is attached to the vest as a separate item and occupies a portion of the MOLLE locations. Ends of the collar are attached to the front of the vest and a center part of the collar wraps around the rear of a wearer's neck. The flotation collar does not extend the full length of the vest in the front. The attached ends of the collar are located at positions roughly corresponding to the lower chest of a wearer.

Several issues can arise in connection with the CMU-33. One such issue relates to the thickness of the flotation collar prior to inflation. In particular, various flotation collar designs are relatively thick in the over-shoulder region and/or may rest against the back of a wearer's neck. This can result in the top of the collar being rubbed by the bottom of a flight helmet that the aircrew member may also be wearing. This rubbing can cause fatigue and discomfort and may restrict head movement.

Another issue relates to accessibility and/or visibility of other survival equipment after inflation of a flotation collar. In many conventional vests, an inflated collar blocks a wearer's view of equipment attached to the vest. The problem may be particularly acute with regard to survival equipment attached to portions of the vest under the ends of the flotation collar.

For these and other reasons, there remains a need for improved wearable flight gear that includes a flotation device.

SUMMARY

This Summary is provided to introduce a selection of concepts in a simplified form that are further described below in the Detailed Description. This Summary is not intended to identify key or essential features of the invention.

A survival vest according to some embodiments includes a vest body. The vest body may include left and right front sections, left and right shoulder sections respectively joined to the left and right front sections, a scapular section joined to the left and right shoulder sections, and a vertebral band joined to the scapular section. A left abdominal section of the left front section may be releasably attachable to a right abdominal section of the right front section to form a bounded neck aperture in the vest body. The aperture may have concave front and rear regions. The vest body may include a bladder containing pouch extending through the left front section, the left shoulder section, the scapular section, the right shoulder section and the right front section. That pouch may include a bladder release gap extending through at least portions of the left front section, the left shoulder section, the scapular section, the right shoulder section and the right front section. A plurality of equipment attachment loops may be located on exterior faces of the left abdominal section and the right abdominal section. At least one strap may join a right side of the left abdominal section, a lower portion of the vertebral band, and a left side of the right abdominal section. An inflatable bladder may be contained within the bladder containing pouch and may be configured to expand outside the bladder containing pouch through a bladder release gap upon inflation so as to push the left abdominal section to the left and push the right abdominal section to the right.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
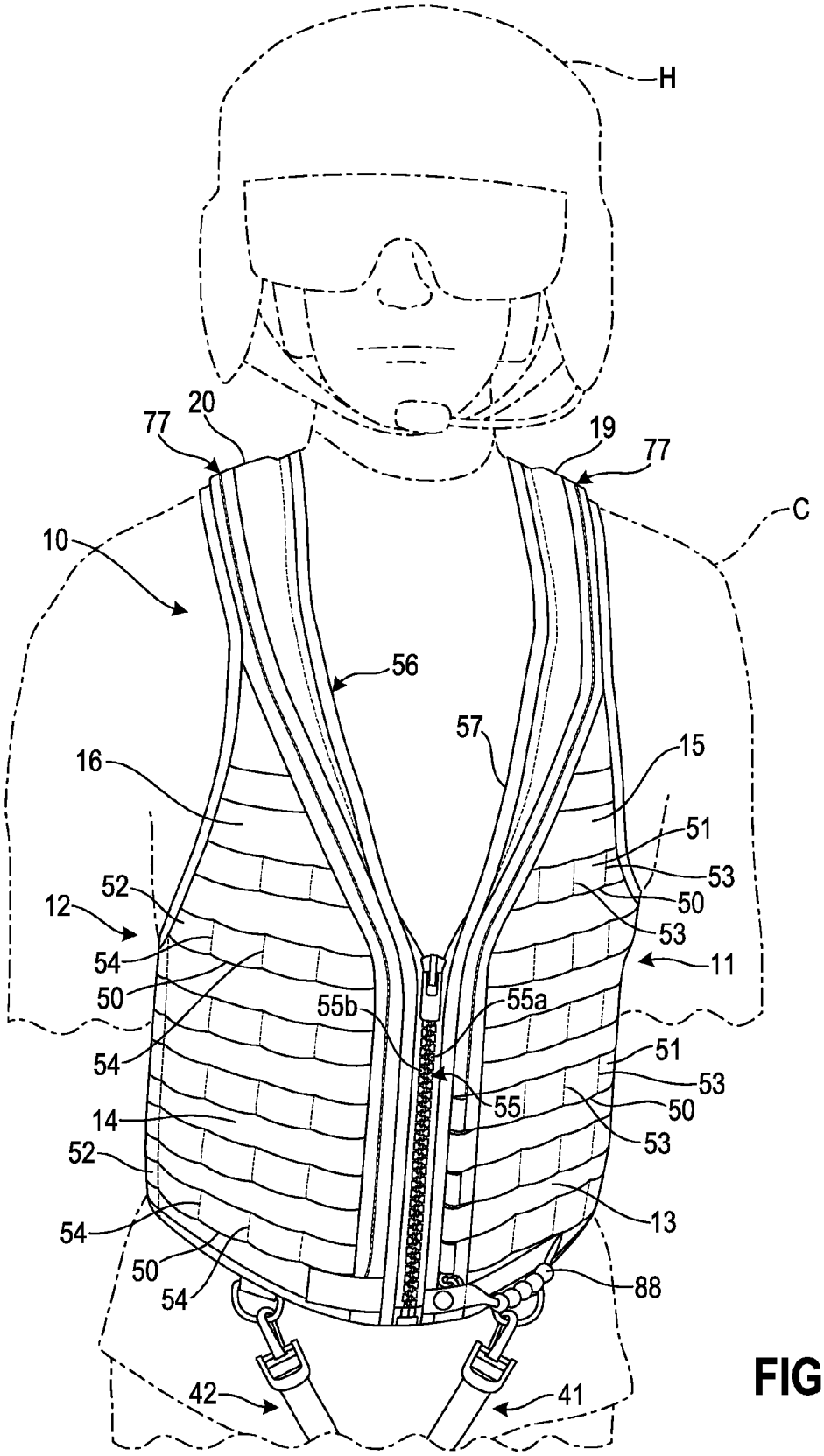
FIG. 1 shows a front view of a survival vest, according to at least some embodiments, in an as-worn and undeployed condition.
Figure 2:
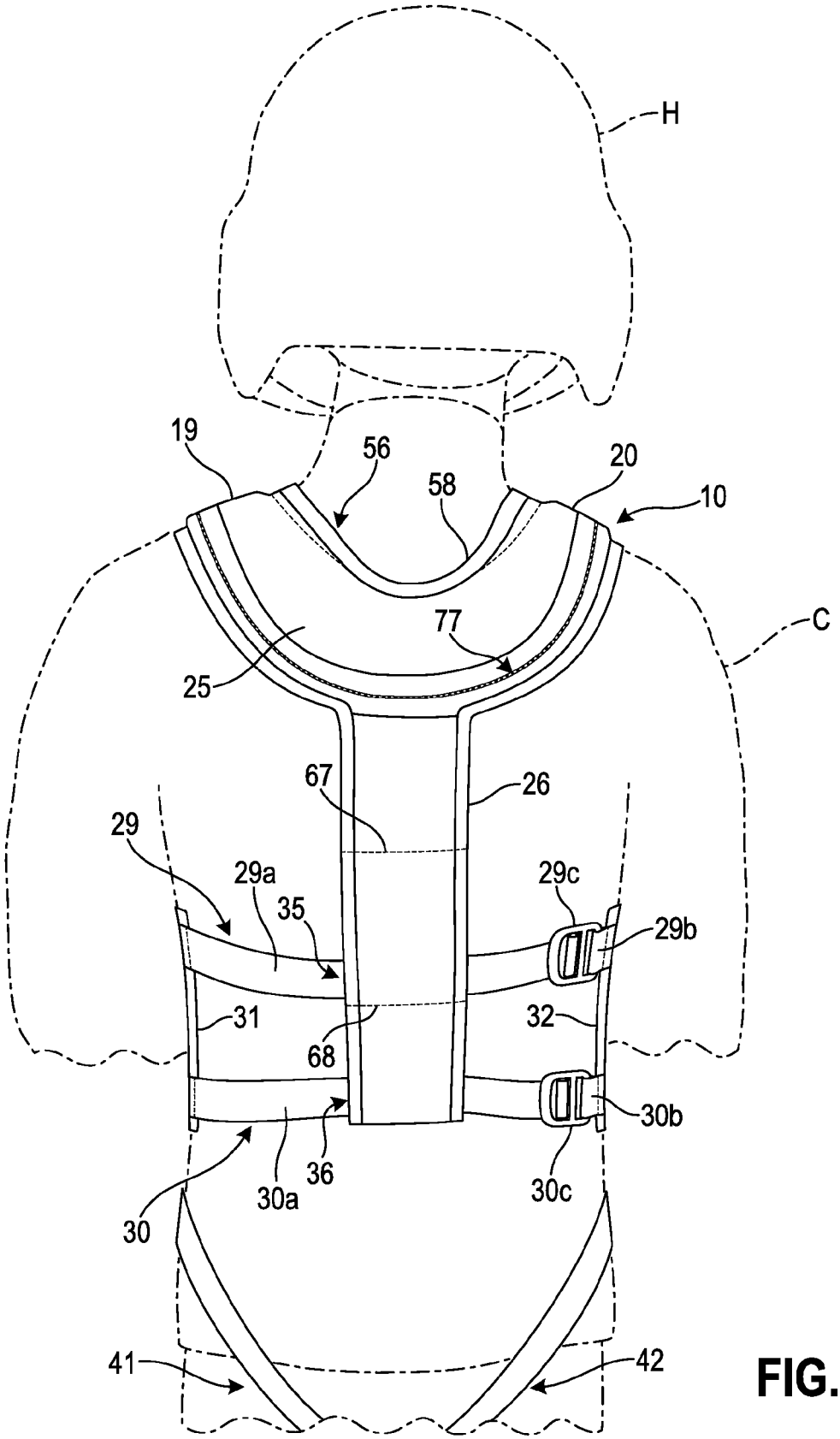
FIG. 2 shows a rear view of the survival vest of FIG. 1 in an as-worn and undeployed condition.
Figure 3:
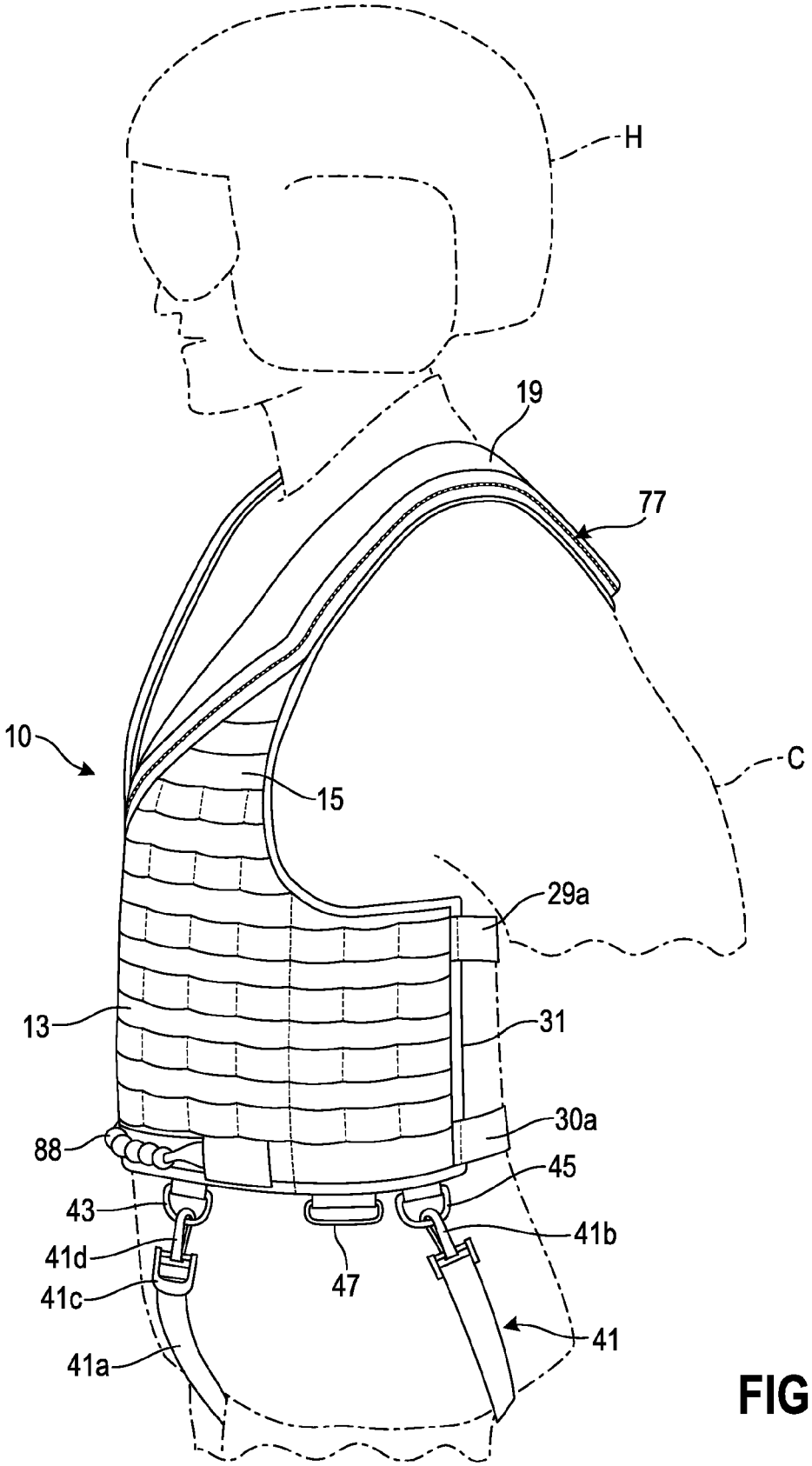
FIG. 3 shows a left side view of the survival vest of FIG. 1 in an as-worn and undeployed condition.
Figure 4:
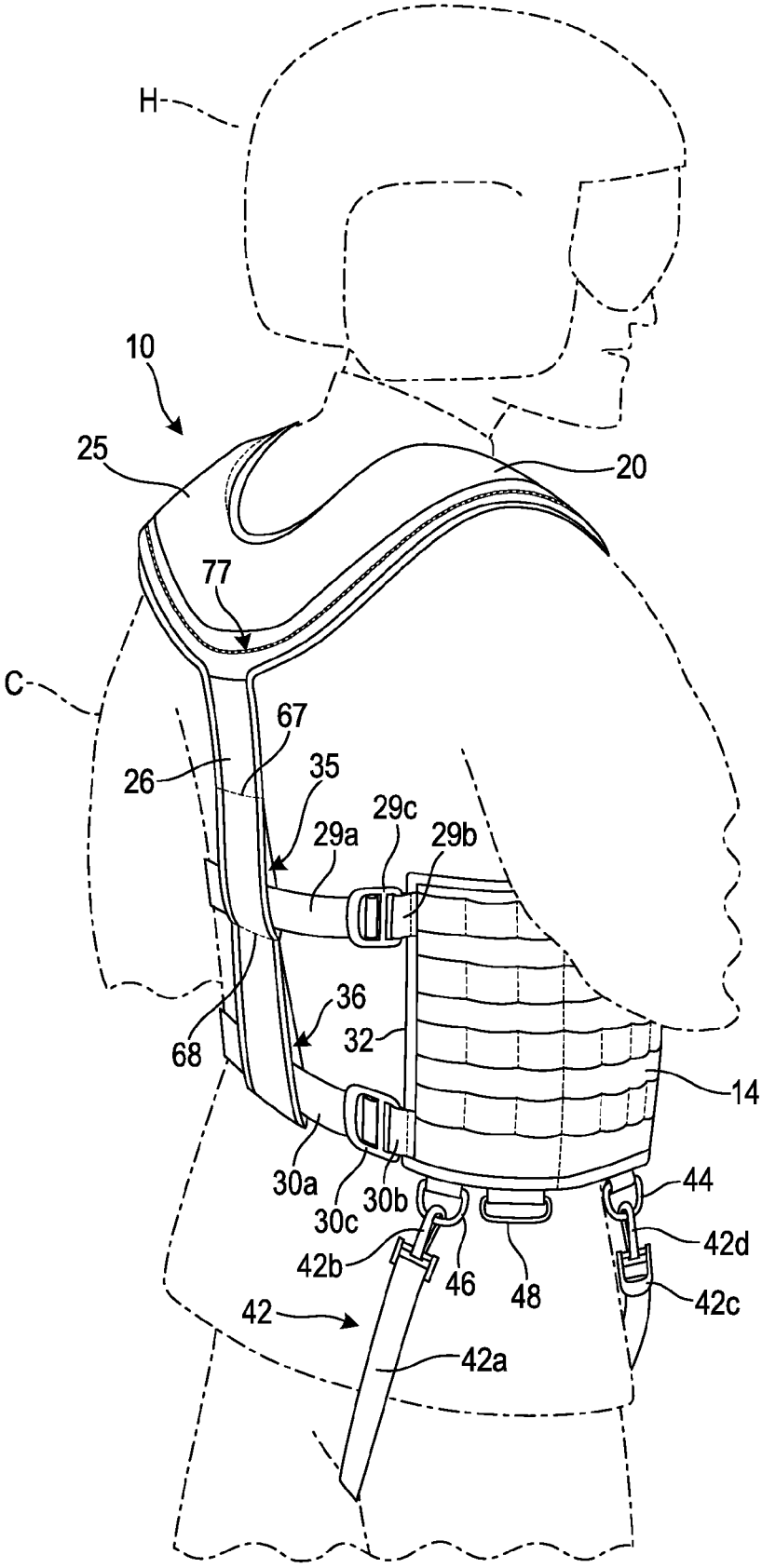
FIG. 4 shows a right side view of the survival vest of FIG. 1 in an as-worn and undeployed condition.

FIG. 1 shows a front view of a survival vest 10 according to at least some embodiments. FIG. 2 shows a rear view of vest 10. FIGS. 3 and 4 respectively show left and right side views of vest 10. FIGS. 1 through 4 show vest 10 in an as-worn condition. In particular, FIGS. 1 through 4 show vest 10 while it is being worn by an aircrew member C. For purposes of illustration, FIGS. 1 through 4 further depict aircrew member C wearing a flight helmet H. The arms and legs of aircrew member C are omitted from FIGS. 1 through 4.

FIGS. 1 through 4 also show vest 10 in an undeployed condition. As used herein, "undeployed" refers to a condition of vest 10 in which a flotation bladder is not inflated and in which that bladder is folded and contained within a bladder containment pouch of vest 10. The flotation bladder and bladder containment pouch of vest 10 are described below in further detail. Conversely, "deployed" refers to a condition in which the flotation bladder has been inflated and has expanded out of the bladder containment pouch. The deployed condition is also described in further detail herein.

As seen in FIGS. 1 through 4, vest 10 is configured for wear on the torso of a human. For ease of explanation, elements of vest 10 will described by reference to corresponding anatomical regions of a human wearer of vest 10. An element of vest 10 can be considered as corresponding to a region of a wearer's body when that element is generally located over that anatomical region when the undeployed vest is properly worn and secured such as shown in FIGS. 1 through 4.

Turning to FIG. 1, vest 10 includes a left front section 11 and a right front section 12. As used herein, and unless context clearly indicates otherwise, "left," "right," "front" "rear," "lower" and other terms of direction or orientation assume the perspective of a vest 10 wearer. Left front section 11 includes a left abdominal section 13 and a left pectoral section 15. Right front section 12 similarly includes a right abdominal section 14 and a right pectoral section 16. Vest 10 further includes a left shoulder section 19, a right shoulder section 20 and, as seen in FIG. 2, a U-shaped scapular section 25 and a vertebral band 26. As seen in FIGS. 2 through 4, upper and lower strap assemblies 29 and 30 connect left abdominal section 13, right abdominal section 14 and vertebral band 26. Strap assembly 29 includes straps 29*a* and 29*b* and buckle 29*c*. Strap assembly 30 includes straps 30*a* and 30*b* and buckle 30*c*. Left leg strap assembly 41 extends from a front location on a lower edge of left abdominal section 13, under the wearer's crotch, and to a rear location on the lower edge of section 13. Right leg strap assembly 42 extends from a front location on a lower edge of right abdominal section 14, under the wearer's crotch, and to a rear location on the lower edge of section 14. Strap assemblies 29, 30, 41 and 42 are described in further detail below.

Returning to FIG. 1, left abdominal section 13 extends from a zipper 55 at the wearer's midline and across the wearer's left front and left side abdominal regions. Left abdominal section 13 also extends from a bottom edge located at or below the wearer's waist to a location slightly above the bottom of the wearer's sternum and over the left rib cage. Left abdominal section 13 narrows and is joined to left pectoral section 15, with left pectoral section 15 extending from a location slightly above the bottom of the wearer's sternum and over the left rib cage to approximately the wearer's left clavicle.

Right abdominal section 14 extends from zipper 55 and across the wearer's right front and right side abdominal regions. Right abdominal section 14 also extends from a bottom edge located at or below the wearer's waist to a location slightly above the bottom of the wearer's sternum and over the right rib cage. Right abdominal section 14 narrows and is joined to right pectoral section 16, with right pectoral section 16 extending from a location slightly above the bottom of the wearer's sternum and over the right rib cage to approximately the wearer's right clavicle.

Left shoulder section 19 is joined to left pectoral section 15 and extends approximately from the wearer's left clavicle to approximately the left scapular spine (see FIG. 2). Right shoulder section 20 is joined to right pectoral section 16 and extends approximately from the wearer's right clavicle to approximately the right scapular spine. Scapular section 25 is joined to left shoulder section 19 and right shoulder section 20 and extends across the top of the left scapula (shoulder blade), across upper interscapular and vertebral regions, and across the top of the right scapula.

As explained in more detail below, various sections of vest 10 are joined by virtue of having interior and/or exterior faces formed by shared panels of material. As used herein, an exterior side, surface, face or other aspect of a vest 10 element refers to a side, surface, face or other aspect of that element that faces away from a wearer's body when vest 10 is in an as-worn, undeployed condition such as is shown in FIGS. 1 through 4. Conversely, an interior side, surface, face or other aspect of a vest 10 element refers to a side, surface, face or other aspect of that element that faces toward a wearer's body when the vest is in an as-worn, undeployed condition.

The exterior of left abdominal section 13 and of a lower portion of the exterior of left pectoral section 15 include a plurality of equipment attachment loops 50. A plurality of loops 50 are also included on the exterior of right abdominal section 14 and a lower portion of right pectoral section 16. Loops 50 can be, e.g., a MOLLE system comprising rows of PALS webbing. In some embodiments, each row of loops 50 of left front section 11 is created by attaching a band of nylon webbing 51 to the exterior face of section 11 using spaced-apart stitches 53. Each row of loops 50 of right front section 12 is similarly created by attaching a band of nylon webbing 52 to the exterior face of section 11 using spaced-apart stitches 54. To avoid obscuring drawing details, not all loops 50, bands 51 and 52 and stitches 53 and 54 are labeled in FIG. 1 or in subsequent drawing figures.

As seen in FIGS. 2 and 3, left end of strap 29*a* is attached to a rear edge 31 of left abdominal section 13. Similarly, a left end of strap 30*a* is attached to rear edge 31. Left leg strap assembly 41 includes a strap 41*a* with a shackle 41*b* attached to one end. The other end of strap 41*a* passes through a strap length adjustment buckle 41*c*. A shackle 41*d* is attached to buckle 41*c*. Shackles 41*d* and 41*b* are connected to front and rear D-rings 43 and 45, with b-rings 43 and 45 being attached to left abdominal section 13. A stainless steel wire loop 47 is attached to the lower edge of left abdominal section 13 between D-rings 43 and 45.

As seen in FIGS. 2 and 4, right ends of straps 29*b* and 30*b* are attached to a rear edge 32 of right abdominal section 14. Strap 29*b* includes an attached friction buckle 29*c* through which a free end of strap 29*a* is threaded. Strap 30*b* includes an attached friction buckle 30*c* through which a free end of strap 30*a* is threaded. Strap assemblies 29 and 30 can thus be adjusted by varying the lengths of straps 29*a* and 30*a* passing through buckles 29*c* and 30*c*. Right leg strap assembly 42 includes a strap 42*a* with a shackle 42*b* attached to one end. The other end of strap 42*a* passes through a strap length adjustment buckle 42*c*. A shackle 42*d* is attached to buckle 42*c*. Shackles 42*d* and 42*b* are connected to front and rear D-rings 44 and 46, with D-rings 44 and 46 being attached to right abdominal section 14. A stainless steel wire loop 48 is attached to the lower edge of right abdominal section 14 between D-rings 44 and 46. Stainless steel wire loops 47 and 48 can be used to attach accessories such as, e.g., a weapon holster.

Vertebral band 26 includes upper and lower channels 35 and 36 (FIG. 2). Each of channels 35 and 36 is open at left and right edges of vertebral band 26 but closed at the top and bottom. Strap assembly 29 passes through and is captured by upper channel 35. Strap assembly 30 passes through and is captured by lower channel 36.

As seen in FIG. 1, a right edge of left abdominal section 13 is releasably attachable to a left edge of right abdominal section 14 by a separable nylon jacket zipper 55. Zipper 55 includes a left tooth chain 55*a* sewn to the right edge of left abdominal section 13 and a right tooth chain 55*b* sewn to the left edge of right abdominal section 14. When zipper 55 is "zipped" (i.e., when the teeth of chains 55*a* and 55*b* are intermeshed), a bounded neck aperture 56 is formed in vest 10. Neck aperture 56 is defined by an inside edge of an upper portion of left abdominal section 13, by inside edges of left pectoral section 15, left shoulder section 19, scapular section 25, right shoulder section 20 and right pectoral section 16, and by an inside edge of an upper portion of right abdominal section 14. Neck aperture 56 includes a V-shaped front region 57 defined by inside (right) edges of left abdominal section 13, left pectoral section 15 and left shoulder section 19 and by inside (left) edges of right abdominal section 14, right pectoral section 16 and right shoulder section 20. Neck opening 56 also includes a concave U-shaped rear region 58 defined by the inside edge of scapular section 25 (FIG. 2).

Also shown in FIGS. 1 through 4 are zipper 77 and handle 88. These components are described in further detail below.

Figure 5:
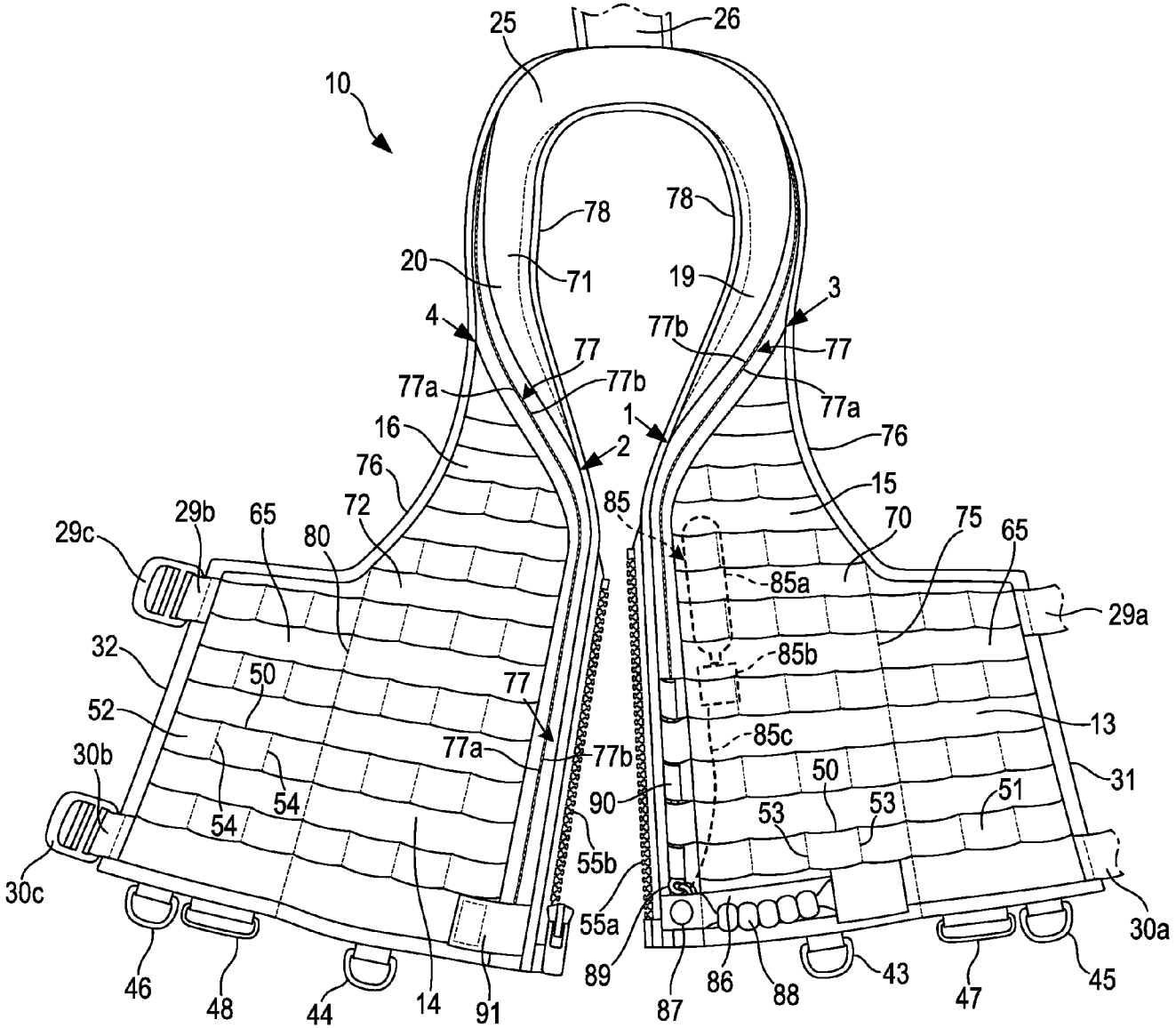
FIG. 5 is a plan view of the exterior face of the survival vest of FIG. 1 in an unworn and flattened condition.

FIG. 5 is a plan view of the exterior face of vest 10 in an unworn and undeployed condition. For purposes of illustration, FIG. 5 further shows vest 10 in a partially disassembled and flattened condition. Specifically, straps 29*a* and 30*a* of strap assemblies 29 and 30 have been removed from buckles 29*c* and 30*c* and withdrawn from channels 35 and 36. Scapular section 25 has then been moved upward and the rear portions of abdominal sections 13 and 15 moved forward. For convenience, most of scapular section 26 and most of straps 29*a* and 29*b* have been removed in FIG. 5.

Figure 6:
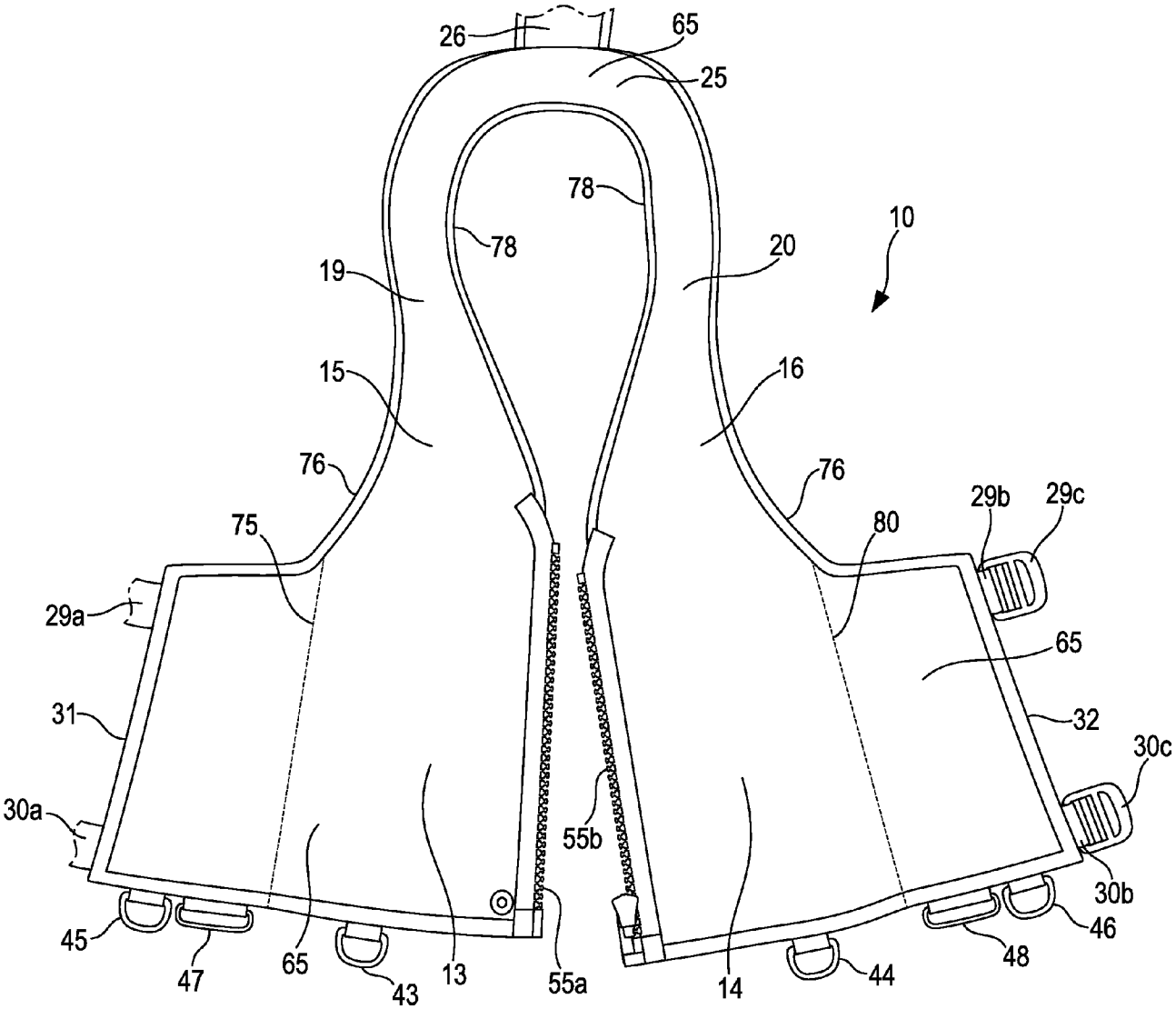
FIG. 6 is a plan view of the interior face of the survival vest of FIG. 1 in an unworn and flattened condition.

FIG. 6 is a plan view of the interior face of vest 10 in the same unworn, undeployed and flattened condition of FIG. 5. Vest 10 includes a single main panel 65 that extends across substantially all of left abdominal section 13, left pectoral section 15, left shoulder section 19, scapular section 25, right shoulder section 20, right pectoral section 16 and right abdominal section 14. An extension of main panel 65 is also used to form vertebral band 26. In particular, the portion of main panel 65 extending from the center rear part of scapular section 25 is folded over. Stitches 67 and 68 (see FIG. 2) are then added to the folded-over portion so as to create channels 35 and 36.

Returning to FIG. 5, vest 10 further includes a left panel 70, a center panel 71 and a right panel 72 that are attached to the exterior face of main panel 65. Left panel 70 extends across left abdominal and lower left pectoral regions of vest 10. A left side of left panel 70 is stitched to main panel 65 along seam 75 and along a portion of an outer seam 76 (between the top end of seam 75 and location 3). The right side of left panel 70 is stitched to a portion of tooth chain 77*a* forming an outside half of a light gauge nylon zipper 77. The right side of left panel 70 is stitched to the portion of tooth chain 77*a* extending from location 3 to the bottom right corner of panel 70. The inside half of zipper 77 is formed by a tooth chain 77*b*. The portion of tooth chain 77*b* below location 1 is stitched to main panel 65. A bottom left portion of zipper 77 is covered in FIG. 5 by loops 90 and pin 89, as described in further detail below. The bottom edge of left panel 70 is generally aligned with a portion of the bottom edge of main panel 65 in the left abdominal region. A left side bottom edge portion of panel 70 adjacent to seam 75 is stitched to main panel 65. A right side bottom edge portion of panel 70 is unattached to main panel 65.

Center panel 71 extends across upper left pectoral, left shoulder, scapular, right shoulder and upper right pectoral regions of vest 10. An inner edge of center panel 71 is stitched to panel 65 along an inner seam 78, between locations 1 and 2, and around most of neck aperture 56. An outer edge of center panel 71 is stitched to tooth chain 77*b* of zipper 77 between locations 1 and 2. The portion of tooth chain 77*a* between locations 1 and 3 is stitched to left panel 70, as previously indicated. The portion of tooth chain 77*a* between locations 3 and 4 is stitched to main panel 65 along outer seam 76.

Right panel 72 extends across upper right pectoral and right abdominal regions of vest 10. A right side of right panel 72 is stitched to main panel 65 along outer seam 76 (between location 4 and a top of seam 80) and along seam 80. The left side of right panel 72 is stitched to a portion of tooth chain 77*a* beginning at location 4 and extending to the bottom left corner of panel 72. The portion of tooth chain 77*b* below location 2 is stitched to main panel 65. A bottom right portion of zipper 77 is covered in FIG. 5 by tab 91, as described in further detail below. The bottom edge of right panel 72 is generally aligned with a portion of the bottom edge of main panel 65 in the right abdominal region. A right side bottom edge portion of panel 72 adjacent to seam 80 is stitched to main panel 65, with a left side bottom edge portion of panel 72 being unattached to main panel 65.

As indicated above, webbing bands 51 and 52 are attached to vest 50 so as to form attachment loops 50. On the left side of vest 10, portions of bands 51 to the left of seam 75 are stitched to the exterior face of main panel 65. Portions of bands 51 to the right of seam 75 are stitched to the exterior face of left panel 70 but are not stitched to main panel 65. On the right side of vest 10, portions of bands 52 to the right of seam 80 are stitched to the exterior face of main panel 65. Portions bands 52 to the left of seam 80 are stitched to the exterior face of right panel 72 but are not stitched to main panel 65.

Figure 7:
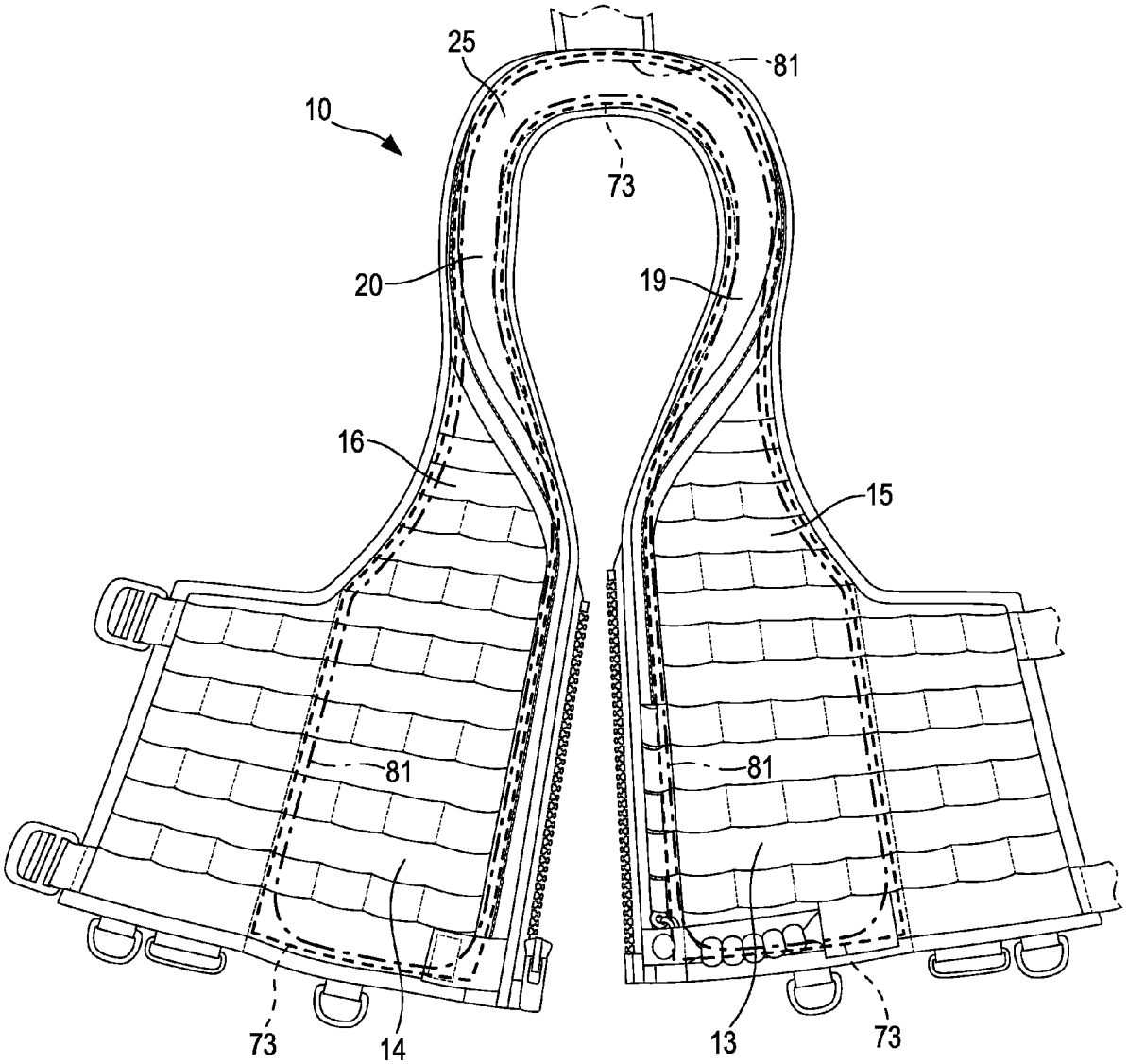
FIG. 7 is another plan view of the exterior face of the survival vest of FIG. 1 in an unworn and flattened condition.

Panels 70, 71 and 72, together with portions of main panel 65 covered by panels 70, 71 and 72, define a bladder containment pouch 73. FIG. 7 is similar to FIG. 5 and is a plan view of the exterior face of vest 10 in an unworn and undeployed condition. The location of bladder containment pouch 73 is indicated in FIG. 7 with even broken lines. Bladder containment pouch 73 extends through right abdominal section 14, right pectoral section 16, right shoulder section 20, scapular section 25, left shoulder section 19, left pectoral section 15 and left abdominal section 13. Also shown in FIG. 7, using uneven broken lines, is the location of an uninflated and folded flotation bladder 81 that is held within bladder containment pouch 73. Zipper 77 joins the edges of a bladder release gap in pouch 73. In effect, tooth chain 77*a* forms one edge of that gap and tooth chain 77*b* forms the other edge of that gap. The teeth of chains 77*a* and 77*b* are intermeshed meshed together when bladder 81 is packed into pouch 73. Zipper 77 lacks a bridge stop or other connection between the chains 77*a* and 77*b* on at least one end, thereby allowing chain separation in response to the force of an expanding bladder 81. When activated, and as explained in further detail below, bladder 81 expands and causes chains 77*a* and 77*b* to separate. Inflated bladder 81 expands out of pouch 73 through the bladder release gap as it forces separation of tooth chains 77*a* and 77*b*.

The bladder release gap of bladder containment pouch 73 is located adjacent the inside edges of abdominal sections 13 and 14. During operation, and as explained in further detail below, this facilitates pushing of abdominal sections 13 and 14 to the side as bladder 81 inflates.

Returning to FIG. 5, vest 10 also includes an inflator 85. Because inflator 85 is located inside of bladder containment pouch 73 when vest 10 is in an undeployed configuration, the position of inflator 85 is indicated in FIG. 5 using broken lines. Flotation vest inflators are commercially available, off-the-shelf components and are well known in the art. Inflator 85 comprises a reservoir 85*a* of compressed gas (e.g., $CO_2$) and a fitting 85*b* attached to bladder 81. A mouth of reservoir 85*a* is sealed with a cap and secured in a gas flow passage of fitting 85*b*. Another opening of that gas flow passage is in fluid communication with the interior of bladder 81. In response to tension on a lanyard 85*c*, a needle within the gas flow passage of fitting 85*b* pierces the cap of reservoir 85*a*. Gas then flows from reservoir 85*a* through fitting 85*b* and into bladder 81. Fitting 85*b* may include a check valve or other component to prevent gas from escaping bladder 81 through fitting 85*b*.

Figure 8A:
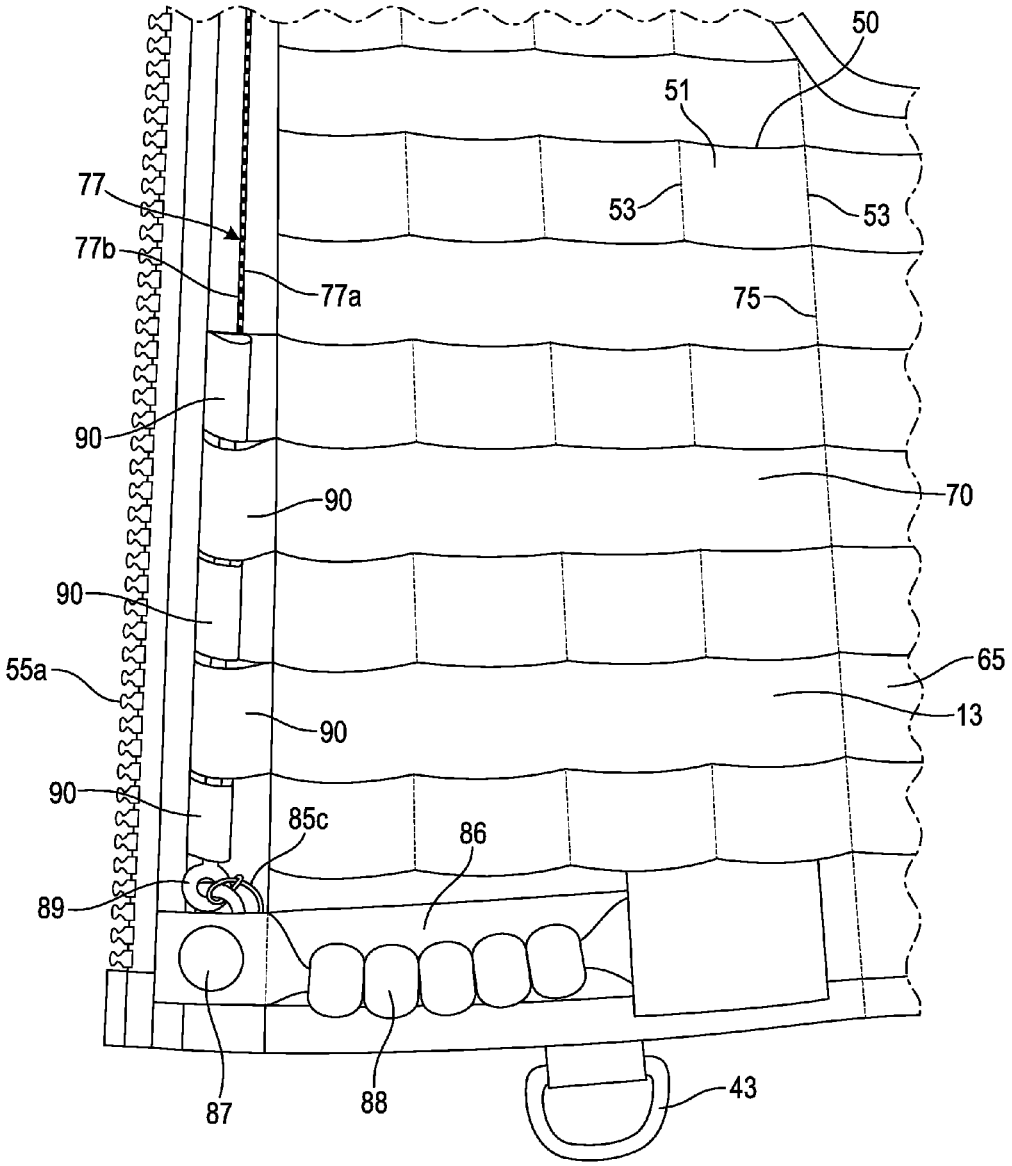
FIGS. 8A and 8B are enlarged views of a lower left portion of a left abdominal section of the survival vest of FIG. 1.

FIG. 8A is an enlarged view of a lower left portion of left abdominal section 13. Activation lanyard 85*c* of inflator 85 is attached to an activation strap 86. A first end of strap 86 is stitched or otherwise permanently attached to the bottom edge of left abdominal section 13. A second end of strap 86 is releasably secured to the bottom edge of section 13 by a snap 87. A pull handle 88 is attached to the outside of strap 86. Securing one end of strap 86 with snap 87 helps to prevent inadvertent inflation of bladder 81 if strap 86 or handle 88 is accidentally snagged by an external object.

Figure 8B:
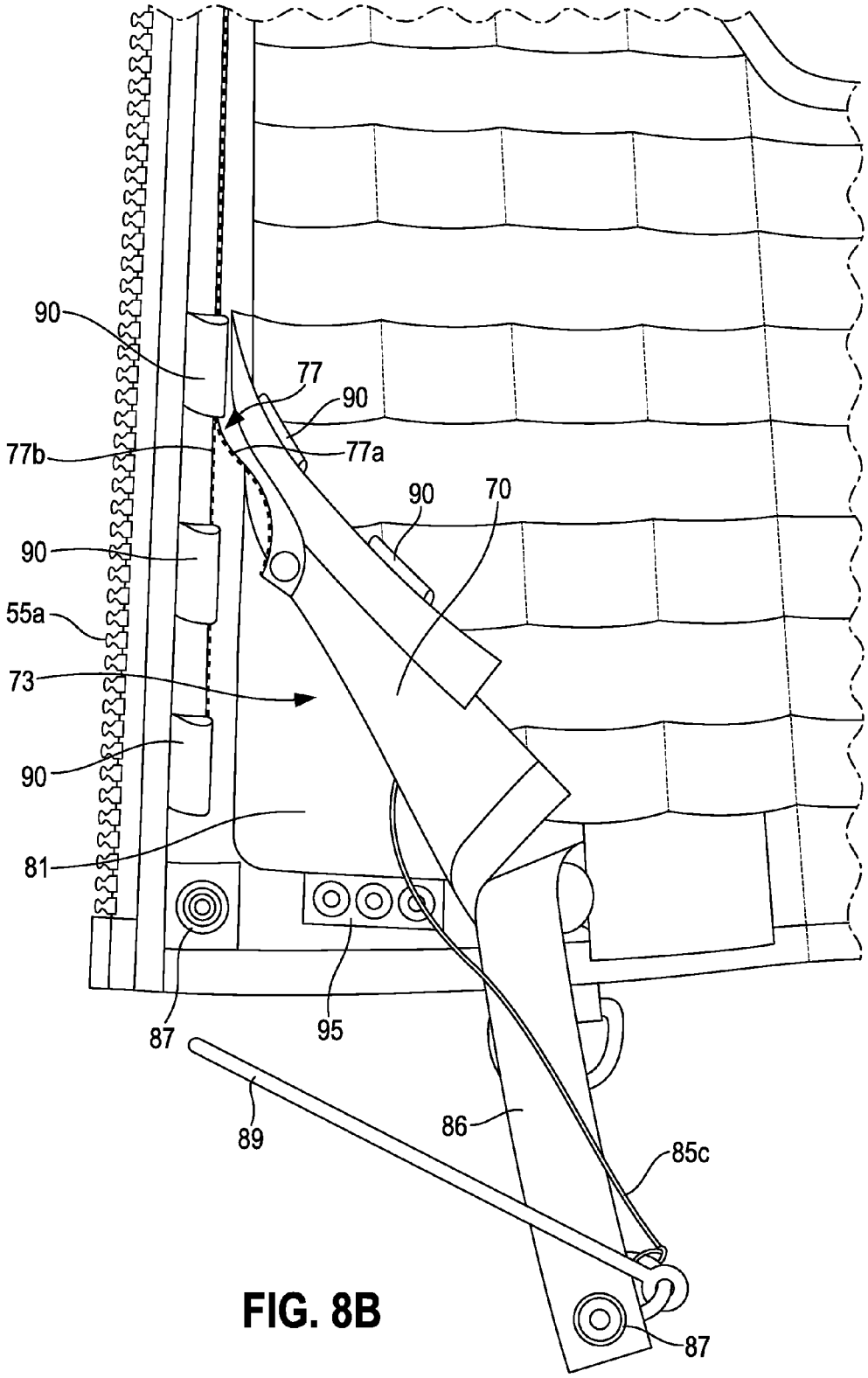

As also shown in FIG. 8A, a pin 89 extends through loops 90 that are attached on alternate side of zipper 77. When inserted through loops 90 in this manner, pin 89 provides supplemental restraint to prevent the left side bottom ends of chains 77*a* and 77*b* from inadvertently separating. Pin 89 is also attached to the free end of strap 86. When a wearer of vest 10 pulls handle 88 to inflate bladder 81, and as shown in FIG. 8B, pin 89 is also pulled from loops 90. This releases the supplemental restraint holding the bottoms of chains 77*a* and 77*b* together. As a result, inflating bladder 81 easily separates chains 77*a* and 77*b* beginning at the left bottom end of zipper 77. That separation then continues the length of zipper 77 as bladder 81 continues to inflate. Also visible in FIG. 8B is an attachment point 95 of bladder 81 to main panel 65. For convenience, and so as to better show positions of various components in an undeployed state, FIG. 8B does not show bladder 81 inflating in response to pulling of lanyard 85*c*.

Figure 9A:
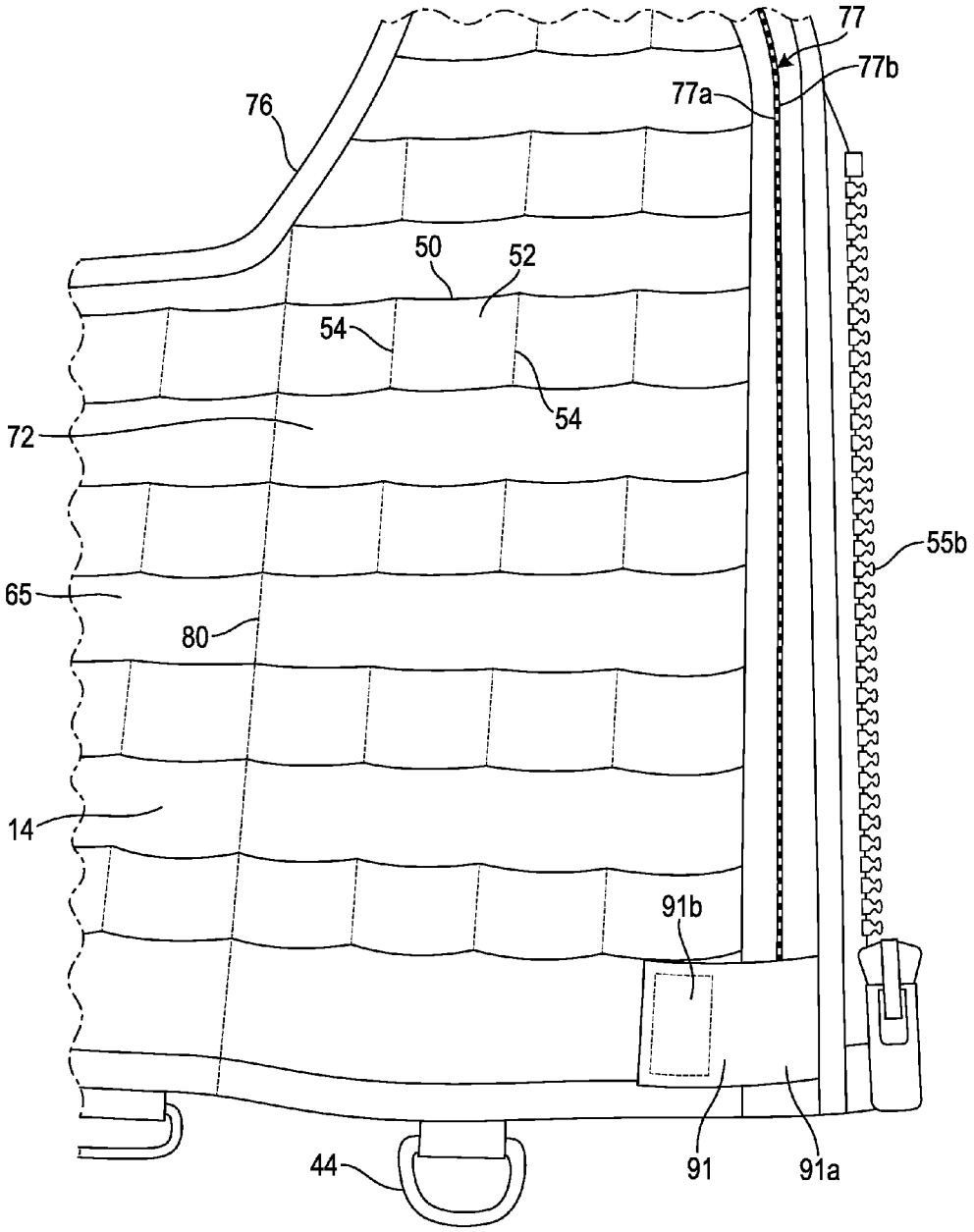
FIGS. 9A and 9B are enlarged views of a lower right portion of a right abdominal section of the survival vest of FIG. 1.
Figure 9B:
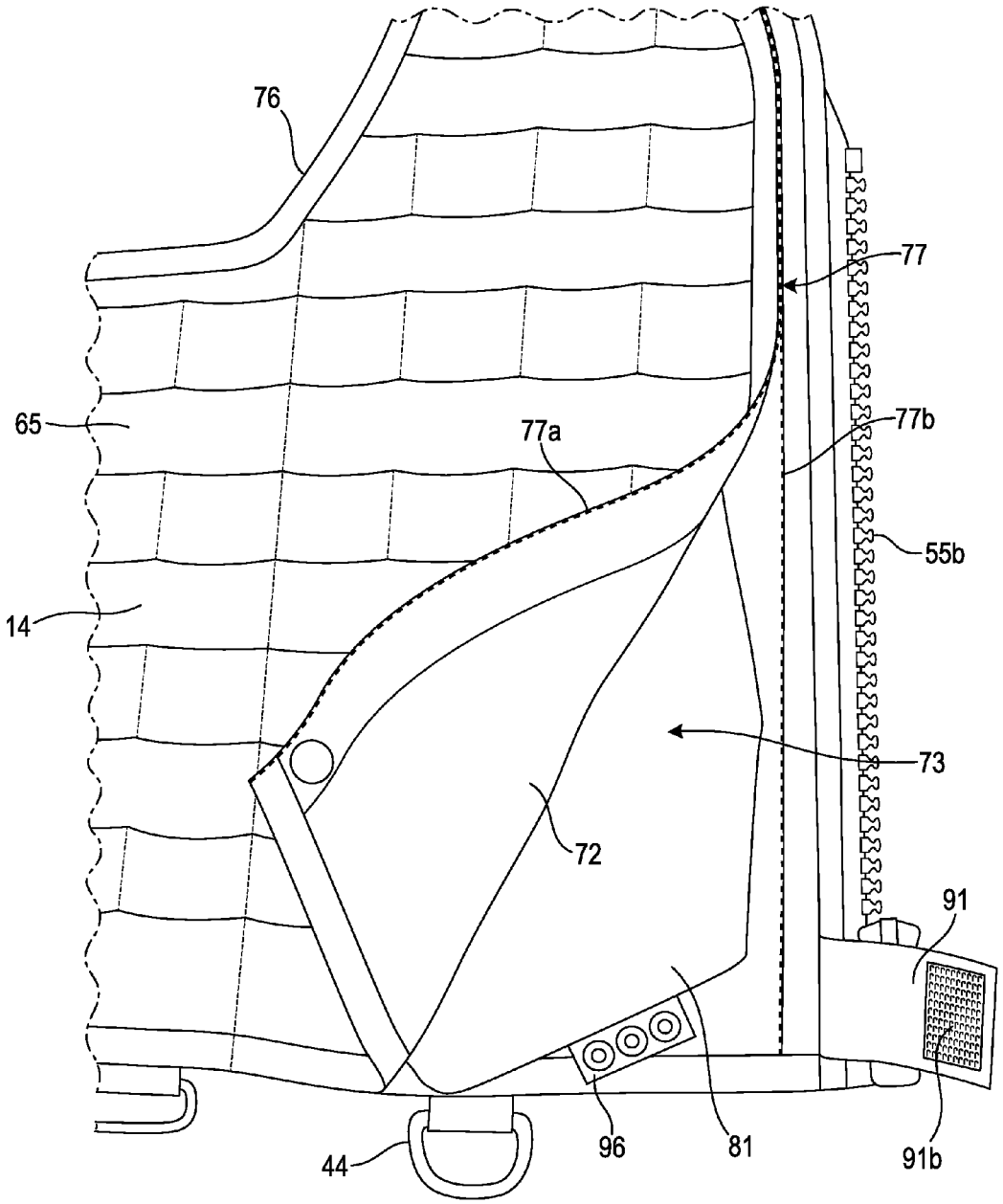

FIG. 9A is an enlarged view of a lower right portion of right abdominal section 13. A tab 91 provides supplemental restraint to prevent to the right side bottom ends of chains 77*a* and 77*b* from separating. A left end 91*a* of tab 91 is stitched to main panel 65. A right end 91*b* has a patch of hook fastening material on its interior face. A patch of pile fastening material is located in a corresponding position on the lower left corner of the exterior face of right panel 72. FIG. 9B is another enlarged view of the lower right portion of right abdominal section 13, but with tab 91 disengaged from panel 72, and with the lower left corner of panel 72 folded back to expose bladder 81 and a portion of pouch 73. In operation, tab 91 need not disengage from panel 72 in order for bladder 81 to fully deploy. However, manual disengagement of tab 91 may be useful to when packing bladder 81 into pouch 73. Also visible in FIG. 9B is an attachment point 96 of bladder 81 to main panel 65.

Figure 10:
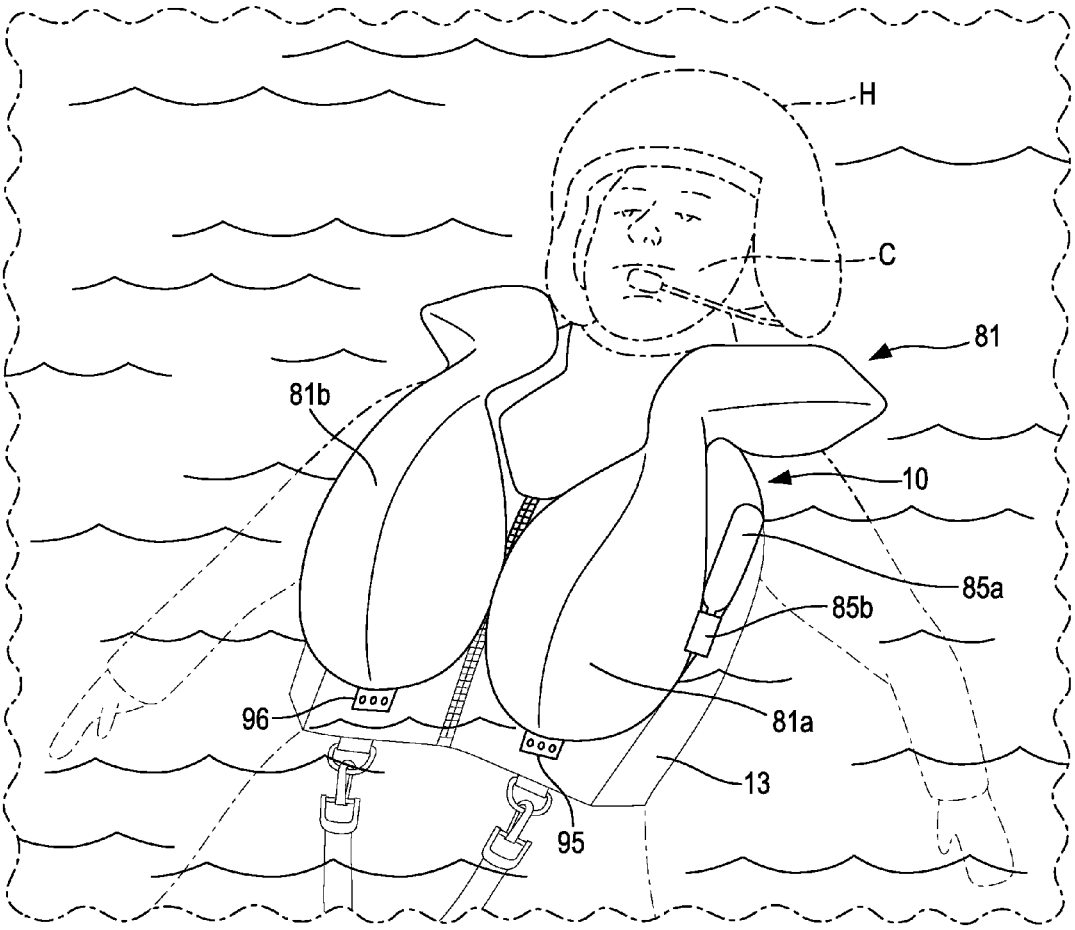
FIG. 10 is a front view of the survival vest of FIG. 1 in an as-worn and deployed condition.

FIG. 10 is a front view of survival vest 10 in an as-worn and deployed condition. In particular, FIG. 10 shows crew member C in water after inflating bladder 81 by pulling handle 88. Bladder 81 includes two large lobes 81*a* and 81*b* positioned over the abdomen and lower chest of crew member C. A smaller collar lobe 81*c* is joined to lobes 81*a* and 81*b* and wraps around the neck of crew member C. As previously shown in FIGS. 8B and 9B, the attachment points 95 and 96 of the bottom ends of lobes 81*a* and 81*b* are located at the bottom edge of main panel 65. This results in the attachment of main lobes 81*a* and 81*b* in a waist region. As seen in FIG. 10, this facilitates a more optimal flotation position wherein crew member C is reclined backward and facing upward.

Figure 11:
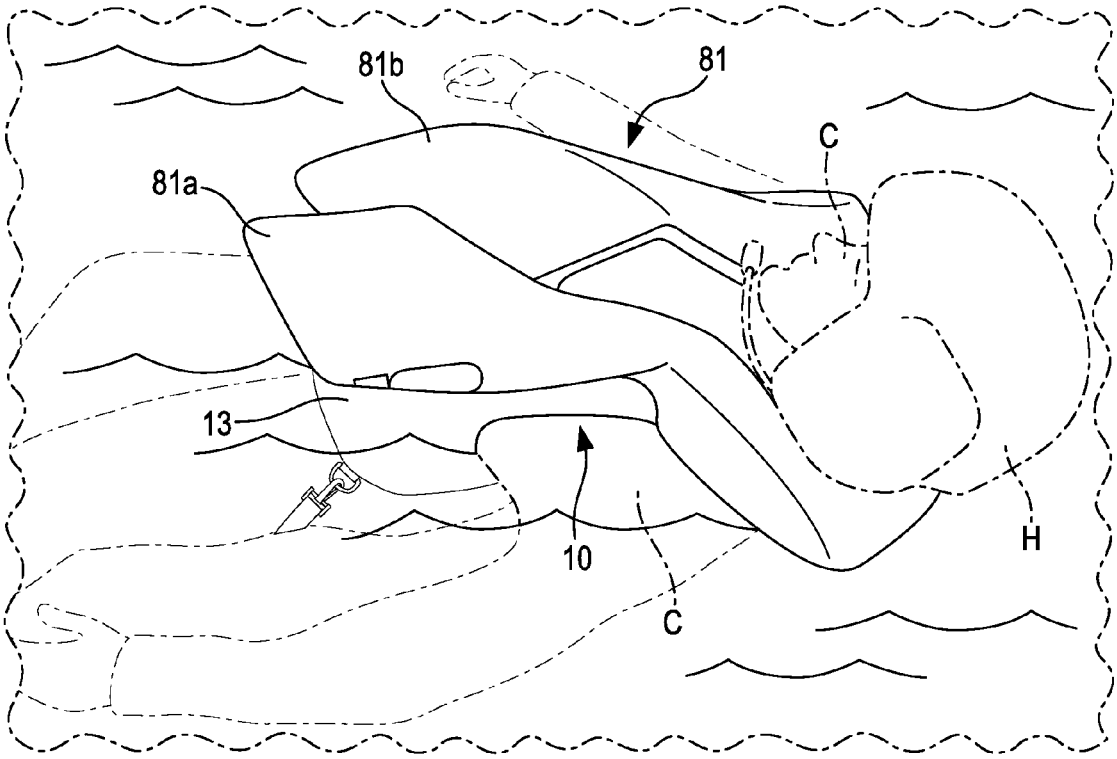
FIG. 11 is a left side view of the survival vest of FIG. 1 in an as-worn and deployed condition.

As also shown in FIG. 10, and as further shown in FIG. 11, the placement of the bladder release gap along the abdominal center line offers further advantages. When bladder 81 inflates, main lobe 81*a* pushes left abdominal section 13 to the left and main lobe 81*b* pushes right abdominal section 14 to the right. The abdominal sections are then easily accessible and visible by crew member C. Survival equipment secured to loops 50 in these abdominal sections can then be visualized and reached more easily than would be possible in other designs. Notably, it is not necessary to secure survival equipment to positions that would be beneath the lower ends of lobes 81*a* and 81*b* when bladder 81 inflates, and which may then be difficult for the crew member to see or reach.

An additional advantage of vest 10 can be seen in FIGS. 1-4. Unlike conventional survival vests that require attachment of a flotation collar as a separate component, flotation bladder 81 is incorporated into vest 10. This permits a much lower survival vest profile in the shoulder and neck regions. As a result, there is less potential for interference with the bottom of a flight helmet.

As a further advantage over pre-existing designs, vest 10 need not utilize any of loops 50 for attachment of a flotation collar. This can allow more efficient use of loops 50 for placement of survival equipment.

In some embodiments, panels 65, 70, 71 and 72 are cut from larger sheets of woven nylon fabric. A rip stop nylon fabric can be used. Examples of materials than can be used for panels 65, 70, 71 and 72 according to various embodiments include, without limitation, Cordura® Nylon fabric, Nomex®/Kevlar® rip-stop woven fabric, HaloTech FR® fabric, etc. Straps of strap assemblies 29, 30, 41 and 42, strips 51, 52 and 86, and other elements can be formed from nylon webbing. In some embodiments, bladder 81 can be formed from 200 denier polyurethane coated nylon material and sized so as to provide at least 45 pounds of buoyancy when inflated. Elements of vest 10 can be stitched together using nylon thread.

Other embodiments include numerous variations on the above described features. For example, other materials can be used for some or all components. As another example, shapes and/or orientations of various features can be modified.

The foregoing description of embodiments has been presented for purposes of illustration and description. The foregoing description is not intended to be exhaustive or to limit embodiments to the precise form explicitly described or mentioned herein. Modifications and variations are possible in light of the above teachings or may be acquired from practice of various embodiments. The embodiments discussed herein were chosen and described in order to explain the principles and the nature of various embodiments and their practical application to enable one skilled in the art to make and use these and other embodiments with various modifications as are suited to the particular use contemplated. Any and all permutations of features from above-described embodiments are the within the scope of the invention. With regard to claims directed to an apparatus, an article of manufacture or some other physical component or combination of components, a reference in such a claim to a potential or intended wearer or a user of a component or to a component corresponding to a portion of a user's or wearer's body does not require actual wearing or using of the component or the presence of the wearer or user as part of the claimed component or component combination.

The invention claimed is:

1. An article comprising:

a vest body including left and right front sections, left and right shoulder sections respectively joined to the left and right front sections, a scapular section joined to the left and right shoulder sections, and a vertebral band joined to the scapular section, wherein a left abdominal section of the left front section is releasably attachable to a right abdominal section of the right front section to form a bounded neck aperture in the vest body, the vest body includes a bladder containing pouch extending through the left front section, the left shoulder section, the scapular section, the right shoulder section and the right front section, the bladder containing pouch having a bladder release gap extending through at least portions of the left front section, the left shoulder section, the scapular section, the right shoulder section and the right front section, over-shoulder portions of the left and right shoulder sections are substantially flat when the article is in an undeployed as-worn configuration, and the scapular section does not extend above the left and right shoulder sections when the article is in an undeployed as-worn configuration;

a plurality of equipment attachment loops located on exterior faces of the left abdominal section and the right abdominal section;

at least one strap joining a right side of the left abdominal section, a lower portion of the vertebral band, and a left side of the right abdominal section; and an inflatable bladder contained within the bladder containing pouch and configured to expand outside the bladder containing pouch through a bladder release gap upon inflation so as to push the left abdominal section to the left and push the right abdominal section to the right.

2. The article of claim 1, further comprising:

a left leg strap connected to front and rear locations on a lower portion of the left abdominal section; and a right leg strap connected to front and rear locations on a lower portion of the right abdominal section.

3. The article of claim 1, wherein a first portion of the bladder release gap is located on a left side of the right abdominal section near a centerline of the article and a second portion of the bladder release gap is located on a right side of the left abdominal section near the centerline of the article.

4. The article of claim 3, wherein the bladder release gap extends continuously through the left front section, the left shoulder section, the scapular section, the right shoulder section and the right front section.

5. The article of claim 1, wherein the bladder includes a left side lobe attached to a front left waist region of the left abdominal section and a right side lobe attached to a front right waist region of the right abdominal section.

6. The article of claim 1, wherein edges of the bladder release gap are joined by intermeshing teeth of zipper chain halves attached to the edges, and the zipper chain halves and teeth thereof are sized to permit separation of the joined bladder release gap edges in response to inflation of the bladder.

7. The article of claim 1, further comprising:

a plurality of extensions attached to locations on opposite sides of the bladder release gap in a lower part of the bladder release gap on one of the left or right abdominal sections; and a pin extending through each of the extensions so as to prevent separation of edges of the bladder release gap in the lower part.

8. The article of claim 7, further comprising a bladder inflator, wherein an activation lanyard of the bladder inflator is coupled to the pin.

9. The article of claim 1, wherein the equipment attachment loops comprise strips of fabric, each of the strips attached to one of the left or right abdominal section exterior faces by a plurality of stitches located between and defining the equipment attachment loops.

10. The article of claim 1, wherein the neck aperture includes a V-shaped front region and U-shaped rear region.

11. The article of claim 1, wherein the vest body comprises a main panel extending over substantially all of the left and right front sections, the left and right shoulder sections, and the scapular section, a left panel attached to an exterior face of the main panel and extending over a portion of the left abdominal section and over a portion of a left pectoral section of the left front section, a center panel attached to the exterior face of the main panel and extending over another portion of the left pectoral section, over the left shoulder section, over the scapular section, over the right shoulder section, and over a portion of a right pectoral section of the right front section, and a right panel attached to the exterior face of the main panel and extending over another portion of the right pectoral section and over a portion of the right abdominal section.

12. The article of claim 11, wherein the left, center and right panels form an exterior side of the bladder retaining pouch and portions of the main panel covered by the left, center and right panels form an interior side of the bladder retaining pouch.

13. The article of claim 1, further comprising:

a left leg strap connected to front and rear locations on a lower portion of the left abdominal section; and a right leg strap connected to front and rear locations on a lower portion of the right abdominal section, and wherein a first portion of the bladder release gap is located on a left side of the right abdominal section near a centerline of the article and a second portion of the bladder release gap is located on a right side of the left abdominal section near the centerline of the article, the bladder release gap extends continuously through the left front section, the left shoulder section, the scapular section, the right shoulder section and the right front section, the bladder includes a left side lobe attached to a front left waist region of the left abdominal section and a right side lobe attached to a front right waist region of the right abdominal section, edges of the bladder release gap are joined by intermeshing teeth of zipper chain halves attached to the edges, and the zipper chain halves and teeth thereof are sized to permit separation of the joined bladder release gap edges in response to inflation of the bladder.

14. An article comprising:

a vest body including left and right front sections, left and right shoulder sections respectively joined to the left and right front sections, a scapular section joined to the left and right shoulder sections, and a vertebral band joined to the scapular section, wherein a left abdominal section of the left front section is releasably attachable to a right abdominal section of the right front section to form a bounded neck aperture in the vest body, and the vest body includes a bladder containing pouch extending through the left front section, the left shoulder section, the scapular section, the right shoulder section and the right front section, the bladder containing pouch having a bladder release gap extending through at least portions of the left front section, the left shoulder section, the scapular section, the right shoulder section and the right front section;

a plurality of equipment attachment loops located on exterior faces of the left abdominal section and the right abdominal section;

at least one strap joining a right side of the left abdominal section, a lower portion of the vertebral band, and a left side of the right abdominal section;

an inflatable bladder contained within the bladder containing pouch and configured to expand outside the bladder containing pouch through a bladder release gap upon inflation so as to push the left abdominal section to the left and push the right abdominal section to the right;

a plurality of extensions attached to locations on opposite sides of the bladder release gap in a lower part of the bladder release gap on one of the left or right abdominal sections; and a pin extending through each of the extensions so as to prevent separation of edges of the bladder release gap in the lower part.

15. The article of claim 14, further comprising a bladder inflator, wherein an activation lanyard of the bladder inflator is coupled to the pin.

16. The article of claim 14, further comprising:

a left leg strap connected to front and rear locations on a lower portion of the left abdominal section; and a right leg strap connected to front and rear locations on a lower portion of the right abdominal section, wherein a first portion of the bladder release gap is located on a left side of the right abdominal section near a centerline of the article and a second portion of the bladder release gap is located on a right side of the left abdominal section near the centerline of the article, the bladder release gap extends continuously through the left front section, the left shoulder section, the scapular section, the right shoulder section and the right front section, and the bladder includes a left side lobe attached to a front left waist region of the left abdominal section and a right side lobe attached to a front right waist region of the right abdominal section.

17. An article comprising:

a vest body including left and right front sections, left and right shoulder sections respectively joined to the left and right front sections, a scapular section joined to the left and right shoulder sections, and a vertebral band joined to the scapular section, wherein a left abdominal section of the left front section is releasably attachable to a right abdominal section of the right front section to form a bounded neck aperture in the vest body, the vest body includes a bladder containing pouch extending through the left front section, the left shoulder section, the scapular section, the right shoulder section and the right front section, the bladder containing pouch having a bladder release gap extending through at least portions of the left front section, the left shoulder section, the scapular section, the right shoulder section and the right front section, the vest body comprises a main panel extending over substantially all of the left and right front sections, the left and right shoulder sections, and the scapular section, the vest body comprises a left panel attached to an exterior face of the main panel and extending over a portion of the left abdominal section and over a portion of a left pectoral section of the left front section, the vest body comprises a center panel attached to the exterior face of the main panel and extending over another portion of the left pectoral section, over the left shoulder section, over the scapular section, over the right shoulder section, and over a portion of a right pectoral section of the right front section, and the vest body comprises a right panel attached to the exterior face of the main panel and extending over another portion of the right pectoral section and over a portion of the right abdominal section;

a plurality of equipment attachment loops located on exterior faces of the left abdominal section and the right abdominal section;

at least one strap joining a right side of the left abdominal section, a lower portion of the vertebral band, and a left side of the right abdominal section; and an inflatable bladder contained within the bladder containing pouch and configured to expand outside the bladder containing pouch through a bladder release gap upon inflation so as to push the left abdominal section to the left and push the right abdominal section to the right.

18. The article of claim 17, further comprising:

a plurality of extensions attached to locations on opposite sides of the bladder release gap in a lower part of the bladder release gap on one of the left or right abdominal sections;

a pin extending through each of the extensions so as to prevent separation of edges of the bladder release gap in the lower part; and a bladder inflator, wherein an activation lanyard of the bladder inflator is coupled to the pin.

19. The article of claim 17, wherein the left, center and right panels form an exterior side of the bladder retaining pouch and portions of the main panel covered by the left, center and right panels form an interior side of the bladder retaining pouch.

20. The article of claim 19, further comprising:

a left leg strap connected to front and rear locations on a lower portion of the left abdominal section; and a right leg strap connected to front and rear locations on a lower portion of the right abdominal section, and wherein a first portion of the bladder release gap is located on a left side of the right abdominal section near a centerline of the article and a second portion of the bladder release gap is located on a right side of the left abdominal section near the centerline of the article, the bladder release gap extends continuously through the left front section, the left shoulder section, the scapular section, the right shoulder section and the right front section, and the bladder includes a left side lobe attached to a front left waist region of the left abdominal section and a right side lobe attached to a front right waist region of the right abdominal section.

* * * * *